US007931120B2

(12) United States Patent
Nishimura et al.

(10) Patent No.: US 7,931,120 B2
(45) Date of Patent: Apr. 26, 2011

(54) EXHAUST DEVICE AND VEHICLE WITH EXHAUST DEVICE

(75) Inventors: Hidehiro Nishimura, Shizuoka-ken (JP); Hiromi Suzuki, Shizuoka-ken (JP); Manabu Shimoishi, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 310 days.

(21) Appl. No.: 11/743,043

(22) Filed: May 1, 2007

(65) Prior Publication Data

US 2007/0251761 A1 Nov. 1, 2007

(30) Foreign Application Priority Data

May 1, 2006 (JP) ..... 2006-127216

(51) Int. Cl.
*F01N 1/14* (2006.01)

(52) U.S. Cl. ..... 181/258; 181/282

(58) Field of Classification Search ..... 181/247, 181/248, 258, 282, 283, 231
See application file for complete search history.

(56) References Cited

U.S. PATENT DOCUMENTS

| | | | | |
|---|---|---|---|---|
| 2,088,919 | A | 8/1937 | Oishei et al. | |
| 3,701,823 | A * | 10/1972 | Hardison | 423/213.7 |
| 3,740,197 | A * | 6/1973 | Scheitlin | 422/171 |
| 3,771,969 | A * | 11/1973 | Scheitlin | 422/171 |
| 4,049,388 | A * | 9/1977 | Scheitlin et al. | 422/171 |
| 4,218,422 | A * | 8/1980 | Schock et al. | 422/171 |
| 4,235,843 | A * | 11/1980 | Tadokoro et al. | 422/119 |
| 4,256,700 | A * | 3/1981 | Smith et al. | 422/177 |
| 4,278,639 | A * | 7/1981 | Tadokoro et al. | 422/171 |
| 4,425,304 | A * | 1/1984 | Kawata et al. | 422/171 |
| 4,501,118 | A * | 2/1985 | Thayer et al. | 60/301 |
| 4,894,987 | A * | 1/1990 | Harwood et al. | 60/299 |
| 5,431,013 | A * | 7/1995 | Yamaki et al. | 60/289 |
| 5,457,290 | A * | 10/1995 | Sase et al. | 181/258 |
| 5,482,681 | A * | 1/1996 | Sager, Jr. | 422/180 |
| 5,590,522 | A * | 1/1997 | Kynsilehto et al. | 60/299 |
| 5,738,184 | A * | 4/1998 | Masuda et al. | 181/262 |
| 5,907,135 | A * | 5/1999 | Hayakawa et al. | 181/282 |
| 6,116,022 | A * | 9/2000 | Woodward | 60/300 |
| 6,789,385 | B2 * | 9/2004 | Glover | 60/293 |

FOREIGN PATENT DOCUMENTS

| | | |
|---|---|---|
| DE | 28 40 200 | 11/1979 |
| DE | 30 45 666 | 7/1982 |
| EP | 1722079 A1 * | 11/2006 |
| FR | 2827908 | 1/2003 |
| TW | 237089 | 8/2005 |
| WO | WO 99/02826 | 1/1999 |

* cited by examiner

OTHER PUBLICATIONS

Aug. 7, 2007 European Search Report for App No. 07251808.7.

*Primary Examiner* — Jeremy Luks
(74) *Attorney, Agent, or Firm* — Keating & Bennett, LLP

(57) ABSTRACT

An exhaust device for a vehicle, such as a scooter type motorcycle, comprises an exhaust pipe and a muffler. A first end portion of the exhaust pipe is connectable to an engine of the vehicle. The muffler includes an outer wall defining an internal space of the muffler. A second end portion of the exhaust pipe is located within the internal space of the muffler. A secondary air induction pipe supplies air to the exhaust pipe and is connected to a portion of the exhaust pipe that is within the internal space of the muffler. The secondary air induction pipe extends to the outside of the muffler via a through hole that has an edge, at least a portion of which is defined by each of a first member and a second member of the muffler.

22 Claims, 10 Drawing Sheets

EXHAUST DEVICE AND VEHICLE WITH EXHAUST DEVICE

RELATED APPLICATION

The present application is based on and claims priority under 35 U.S.C. §119 to Japanese Patent Application No. 2006-127216, filed on May 1, 2006, the entire contents of which is expressly incorporated by reference herein.

BACKGROUND OF THE INVENTION

1. Field of the Invention

The present invention relates to an exhaust device and a vehicle provided with the exhaust device. More particularly, the present invention relates to an exhaust device including an exhaust pipe and an air supply pipe, and a vehicle provided with such an exhaust device.

2. Description of the Related Art

Exhaust devices for vehicles, such as motorcycles and scooters, often include an exhaust pipe, a muffler and an air supply pipe. For example, such an arrangement is disclose in Taiwanese Patent No. 237089. The exhaust device disclosed includes an exhaust pipe, a muffler to which the exhaust pipe is connected, and an air supply pipe connected to the exhaust pipe and that supplies air to the exhaust pipe. In this exhaust device, the muffler includes an outer tubular member that forms an outer wall of the muffler. The air supply pipe is connected to a portion of the exhaust pipe located within the outer tubular member of the muffler. In addition, the air supply pipe is formed to extend through the outer wall of the muffler via an insertion hole formed in the outer tubular member.

SUMMARY OF THE INVENTION

However, in the exhaust device disclosed in Taiwanese Patent No. 237089, as a result of the air supply pipe being formed to extend outside of the muffler via the insertion hole formed in the outer tubular member, when assembly is carried out, it is necessary to carry out a first process step in which the air supply pipe is inserted through the insertion hole of the outer tubular member in addition to a process to secure the air supply pipe to the exhaust pipe. In addition, after the air supply pipe has been inserted through the insertion hole in the outer tubular member, it is necessary to carry out a second process step to connect the air supply pipe to the exhaust pipe by welding or the like while the air supply pipe is inserted in the insertion hole of the outer tubular member. As a result, the assembly operation is difficult and time consuming.

An aspect of preferred embodiments of the present invention is to provide an exhaust device, which allows an assembly operation to be carried out more easily. Another aspect of a preferred embodiment is a vehicle provided with such an exhaust device.

An aspect of a preferred embodiment involves an exhaust device, including an exhaust pipe having a first end portion connectable to an engine. A muffler includes an outer wall defining an internal space of the muffler, wherein a second end portion of the exhaust pipe is located within the internal space of the muffler. An air supply pipe supplies air to the exhaust pipe and is connected to a portion of the exhaust pipe within the muffler. The outer wall of the muffler comprises at least a first member and a second member connected to the first member. The air supply pipe extends to the outside of the muffler via a through hole having an edge at least partially defined by each of the first member and the second member of the muffler.

In an exhaust device as described above, the air supply pipe is formed to extend to the outside of the muffler via the through hole which has the edge at least partially defined by each of the first member and the second member of the muffler. As a result, when assembly is carried out, it is possible to connect the first member and the second member such that the air supply pipe is interposed therebetween. Accordingly, the air supply pipe is positioned so as to extend to the outside of the muffler without having to insert the air supply pipe into the through hole. As a result, the assembly operation of the exhaust device can be carried out more easily. In addition, the air supply pipe is formed to extend to the outside of the muffler via the through hole which has the edge at least partially defined by each of the first member and the second member of the muffler. As a result, when assembly is carried out, the air supply pipe can be connected to the exhaust pipe in advance, and following this the first member and the second member can be connected such that the air supply pipe is interposed therebetween. Accordingly, as compared to an assembly operation in which, after the air supply pipe has been inserted in the through hole, the air supply pipe and the exhaust pipe are connected by welding etc. while the air supply pipe is inserted in the through hole, the assembly operation is easier to carry out.

An aspect of a preferred embodiment involves an exhaust device as described above, wherein one of the first member and the second member of the muffler comprises an exhaust pipe insertion member into or onto which the exhaust pipe is inserted. The exhaust pipe is secured to the insertion member of the muffler. With such a structure, the exhaust pipe can be connected to the muffler easily.

An aspect of a preferred embodiment involves an exhaust device as described above, wherein the exhaust pipe includes a purification member for purifying exhaust gas. With such an arrangement, purified or reduced emissions exhaust gas can be exhausted.

An aspect of a preferred embodiment involves an exhaust device as described above, wherein the purification member is disposed between a portion of the exhaust pipe connected to the muffler and the portion of the exhaust pipe to which the air supply pipe is connected. With such an arrangement, the purification member is disposed to the engine side (the upstream side) of the muffler, whereby the purification member is disposed near the engine. Accordingly, relatively high temperature exhaust gas is able to flow into the purification member, whereby it is possible to reduce the time required to raise the temperature of the purification member to the temperature at which the exhaust gas is effectively purified (the activation temperature). Furthermore, as a result of disposing the purification member between the section of the exhaust pipe that is connected to the muffler, and the section of the exhaust pipe that is connected to the air supply pipe, the purification member is disposed inside the muffler. As a result, it is possible to inhibit the purification member from being cooled by the outside atmosphere. This feature also makes it possible to reduce the time required to raise the temperature of the purification member to the temperature at which the exhaust gas is effectively purified (the activation temperature).

An aspect of a preferred embodiment involves an exhaust device as described above, wherein the purification member includes a catalyst that functions to purify exhaust gas. With such an arrangement, the purification member can efficiently purify the exhaust gas.

An aspect of a preferred embodiment involves an exhaust device as described above, wherein the first member includes a tubular body member, and the second member includes a cap member that is attachable to a first end portion of the tubular body member. When such a structure is adopted, the outer wall of the muffler can easily be formed using the tubular body member and the cap member.

An aspect of a preferred embodiment involves an exhaust device as described above, wherein the cap member is fitted to and connected with an inner surface of the first end portion of the tubular body member. With such an arrangement, the cap member can be easily connected to the tubular body member.

An aspect of a preferred embodiment involves an exhaust device as described above, wherein the first member includes a first notch and the second member includes a second notch corresponding to the first notch. The edge of the through hole is at least partially formed by the first notch and the second notch. With such an arrangement, the edge of the through hole can be easily formed using the first notch of the first member and the second notch of the second member.

An aspect of a preferred embodiment involves an exhaust device as described above, wherein one of the first member and the second member is fitted to an inner surface of the other of the first member and the second member. One of the first notch and the second notch has a depth that is larger than that of the other of the first notch and the second notch. If such a structure is adopted, the notch depth of the notch (the notch of the other one of the first member and the second member) disposed to the outside among the first member and the second member at a connection section of the first member and the second member is not necessarily large in size. As a result, the length of the boundary line of the first member and the second member is not large when viewed from the outside. As a result, when the connection section of the first member and the second member is welded, the length that needs to be welded is not significantly longer than necessary or desired. As a result, the assembly operation is easier to carry out. In addition, the notch depth of the notch of the one of the first member and the second member is formed to be larger than the notch depth of the notch of the other one of the first member and the second member. Accordingly, when the air supply pipe and the edge of the through hole are fixed, even if the exhaust pipe with the connected air supply pipe is fixed in a displaced state with respect to the muffler, the air supply pipe is disposed such that it is displaced in the depth direction of the notch of the one of the first member and the second member. Accordingly, it is possible to inhibit the air supply pipe from being fixed in a state in which it pushes against the edge of the through hole, whereby it is possible to inhibit residual stress being generated in the air supply pipe. As a result, it is possible to inhibit stress of the air supply pipe from becoming too large, as a result of thermal stress caused by heat of the exhaust gas from the engine being applied to the air supply pipe when residual stress is generated in the air supply pipe.

An aspect of a preferred embodiment involves an exhaust device as described above, wherein the first member and the second member of the muffler are welded along an outer surface of the first member and the second member by a first weld bead portion. The air supply pipe and the edge of the through hole of the muffler are welded around the outer surface of the air supply pipe by a second weld bead portion. The first and second weld bead portions are continuous with one another. When such a structure is adopted, when the first member and the second member are welded and the air supply pipe and the edge of the through hole are welded, it is possible to weld the first member and the second member, and then following this successively and continuously weld the air supply pipe and the edge of the through hole. Accordingly, the assembly operation is easier to carry out.

An aspect of a preferred embodiment involves an exhaust device as described above, wherein a weld bead comprising the first weld bead portion and the second weld bead portion extends entirely around a circumference of the outer surface of the muffler. With such an arrangement, as compared to a structure in which the weld line that connects around the circumference around the outer periphery surface of the first member and the second member is formed by just the weld line of the first member and the second member, it is possible to shorten the weld line of the first member and the second member, whereby assembly time can be reduced.

An aspect of a preferred embodiment involves an exhaust device as described above, wherein the muffler includes a third member disposed inside the first member. The third member includes a third notch that corresponds with the first notch of the first member. The first member, the second member and the third member of the muffler are welded around the outer surface of the first member, the second member and the third member. With such an arrangement, the third member can be fixed to the first member and the second member. In addition, as a result of forming the third notch in the region of the third member that corresponds with the first notch of the first member, the position of a tip section of an end section of the third member at the second member side can be located in the vicinity of the position of a tip section of an end section of the first member at the second member side. Accordingly, the first member, the second member and the third member can be welded simultaneously. As a result, the assembly operation is easier to carry out.

An aspect of a preferred embodiment involves an exhaust device as described above, wherein the air supply pipe is welded to the exhaust pipe such that an axis of the air supply pipe is generally perpendicular to an axis of the exhaust pipe. With such an arrangement, as compared to a structure in which the air supply pipe is welded to the exhaust pipe with the axis of the air supply pipe inclined with respect to the axis of the exhaust pipe, it is easier to weld the air supply pipe to the exhaust pipe.

An aspect of a preferred embodiment involves a vehicle that incorporates an exhaust device as described in any of the above paragraphs. As a result, it is possible to provide a vehicle with an exhaust device that allows an assembly operation to be carried out more easily.

BRIEF DESCRIPTION OF THE DRAWINGS

These and other features, aspects and advantages of the present invention are described below with reference to drawings of preferred embodiments, which are intended to illustrate, but not to limit, the present invention. The drawings contain ten (10) figures.

DETAILED DESCRIPTION OF THE PREFERRED EMBODIMENTS

Figure 1:
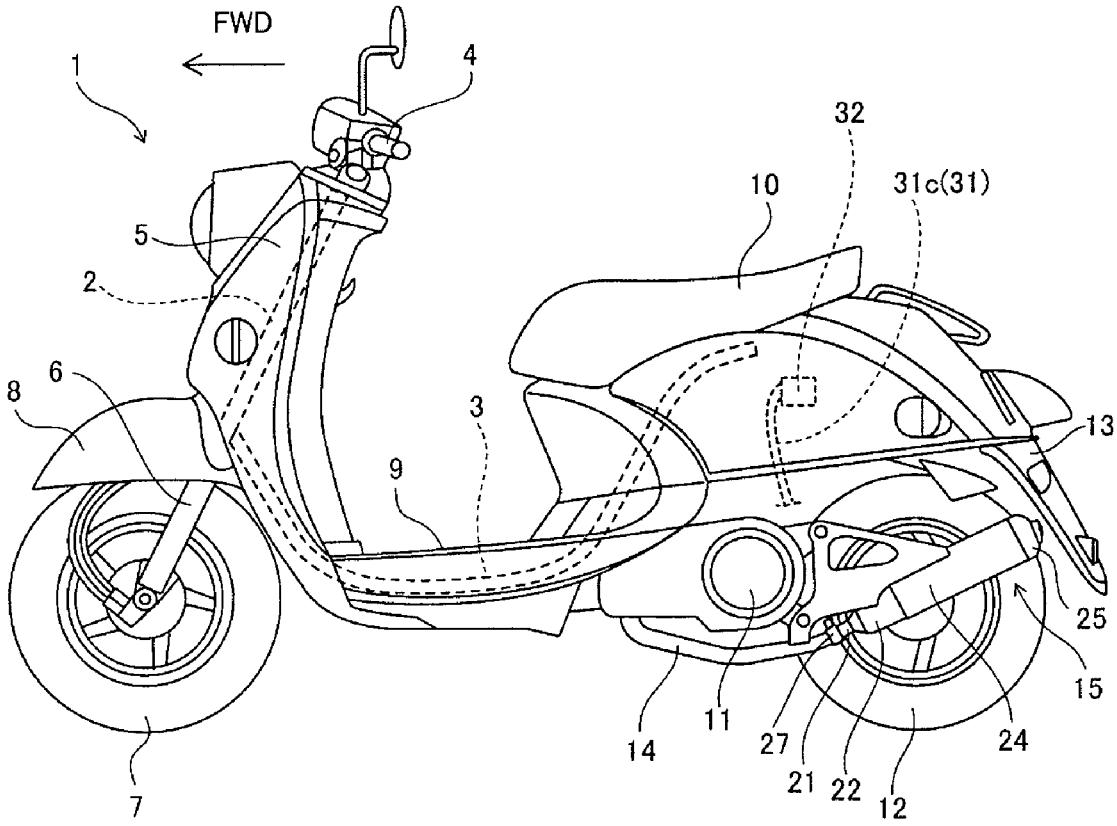
FIG. 1 is a side view of a motorcycle, and in particular a scooter type motorcycle, including an exhaust device having certain features, aspects and advantages of the invention.

FIG. 1 is a side view showing the overall structure of a motorcycle and, in particular, a scooter type motorcycle having an exhaust system having certain features, aspect and advantages of the present invention. FIG. 2 to FIG. 9 illustrate the structure of a muffler of the motorcycle shown in FIG. 1. Note that, the illustrated embodiment of a motorcycle is a scooter-type motorcycle. However, other types of motorcycles, and other types of vehicles, may employ the exhaust device, or particular combinations of features of the exhaust device describer herein. In the figures, FWD indicates the forward direction in the traveling direction of the motorcycle. The structure of a motorcycle 1 is described in greater detail with reference to FIG. 1 to FIG. 9.

In the motorcycle 1 according to the embodiment of the invention, a main frame 3 is fixed to a lower side of a head pipe 2 as shown in FIG. 1. The main frame 3 is formed to extend from the lower side of the head pipe 2 to the rear. The head pipe 2 and the main frame 3 create at least a portion of a vehicle body frame.

In addition, a handlebar 4 is attached to an upper section of the head pipe 2 such that the handlebar 4 can be turned. Moreover, a front cowl 5 is provided at the front side of the head pipe 2 so as to cover the front side of the head pipe 2. Furthermore, a front fork 6 that includes suspension to absorb impacts is disposed beneath and coupled to the head pipe 2. A front wheel 7 is rotatably attached to lower end of the front fork 6. In addition, a front fender 8 is disposed above the front wheel 7.

In addition, a foot rest 9 is disposed on the upper side of a central section of the main frame 3. Furthermore, a seat 10 is disposed on the upper side of a rear section of the main frame 3. Moreover, an engine unit including an engine 11 is disposed beneath the rear section of the main frame 3. A rear wheel 12 is rotatably disposed on the rear side of the engine 11. Furthermore, a rear fender 13 is attached above the rear wheel 12 so as to cover the rear wheel 12.

The motorcycle 1 includes an exhaust system or exhaust device that receives exhaust gases from the engine 11 and delivers the exhaust gases to an external environment. The exhaust device generally includes an exhaust pipe and a muffler. The exhaust pipe defines an exhaust conduit that receives the exhaust gases from the engine 11 and delivers the exhaust gases to the muffler, which preferably reduces the noise associated with the flow of exhaust gases and releases the exhaust gases to the external environment. The exhaust pipe and/or the muffler may be made up of one or more individual components. Preferably, as described below, a downstream end portion of the exhaust pipe is located within a space defined by the muffler. Specifically, a first end of an external portion of an exhaust pipe 14 is connected to the engine 11. The external exhaust pipe 14 faces and extends toward the rear and is connected to a muffler 15. Note that, the muffler 15 is one example of a "muffler" of the invention.

Figure 2:
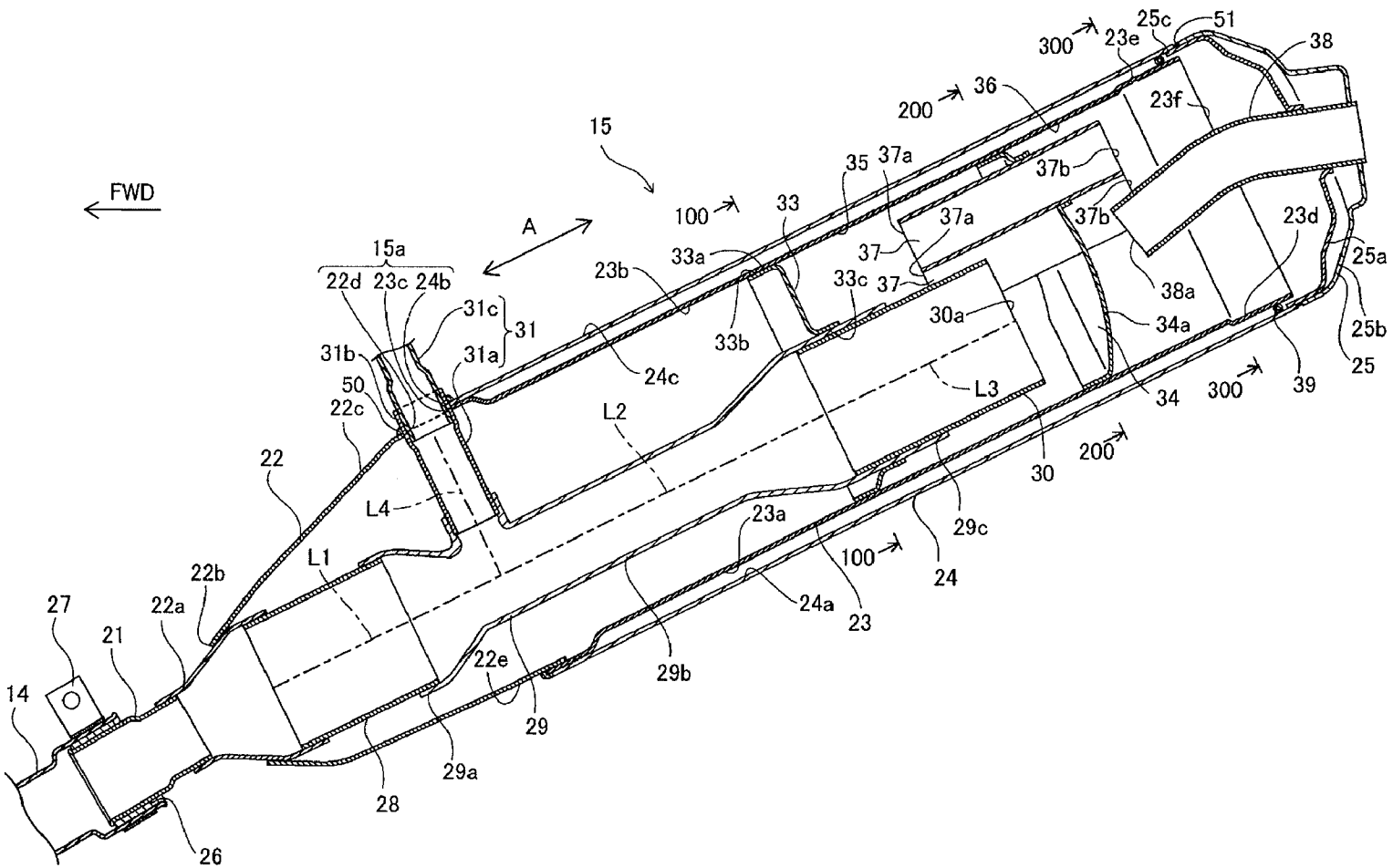
FIG. 2 is a cross sectional view of a muffler of the exhaust device of the motorcycle of FIG. 1.

The muffler 15, as can be seen in FIG. 2, includes a connecting pipe 21 that is connected to the external exhaust pipe 14, a front side cap member 22 that is made of stainless steel or another suitable material and is connected to a rear section of the connecting pipe 21, an inner tubular member 23 that is made of stainless steel or another suitable material and that is secured (e.g., welded) to a rear section of the front side cap member 22. An outer tubular member 24 is secured (e.g., welded) together with the inner tubular member 23 at the rear section of the front side cap member 22 and which is made of stainless steel or another suitable material. The outer tubular member 24 includes an inner surface 24*a* disposed to extend along an outer surface 23*a* of the inner tubular member 23. A rear side cap member 25 is made of stainless steel or another suitable material and is secured (e.g., welded) to a rear section of the outer tubular member 24. More specifically, a front section of the inner tubular member 23 is fixed to the front side cap member 22 and the outer tubular member 24, while the rear section of the inner tubular member 23 is not fixed to the outer tubular member 24. Note that, the front side cap member 22 is one example of an "outer wall", a "second member", and a "cap member" of the preferred embodiment, and the inner tubular member 23 is one example of a "third member" of the preferred embodiment. In addition, the outer tubular member 24 is one example of an "outer wall", a "first member", and a "body member" of the preferred embodiment.

The connecting pipe 21 is connected to the external exhaust pipe 14 by a fixing member 27 with a seal 26 interposed therebetween. In addition, the front side cap member 22 includes a front member 22*a* connected to the rear section of the connecting pipe 21, and a front side cap body member 22*c* that has an insertion member 22*b* inserted in and connected to the front member 22*a*. The rear section of the front side cap body member 22*c* is fitted into and connected to the inner surfaces (23*b* and 24*a*) of the inner tubular member 23 and the outer tubular member 24.

Furthermore, in the illustrated embodiment, a purification tube member 28 formed by a catalyst that functions to react with or purify, and preferably reduce the harmful emission of, exhaust gas is attached to a portion that is further rearward than the portion connected to the front side cap body member 22*c* of the front member 22*a*. Note that, the purification tube member 28 is one example of a "purification member" of the preferred embodiment. Furthermore, an air flow pipe 29 having a large diameter section 29*a*, a smaller diameter section 29*b*, and a large diameter section 29*c* is connected to the rear section of the purification tube member 28. In addition, a purification tube member 30 formed from a catalyst that functions to purify exhaust gas is connected to the rear section of the large diameter section 29*c* of the air flow pipe 29. The purification tube member 28, the air flow pipe 29 and the purification tube member 30 comprise a "purifier". Note that, at temperatures equal to or more than a threshold temperature (an activation temperature) the purifier functions to oxidize HC (hydrocarbon) and CO (carbon monoxide) that remain after combustion of the fuel into $H_2O$ (water) and $CO_2$ (carbon dioxide), and reduce $NO_x$ (nitrogen oxides). In addition, the external exhaust pipe 14, the connecting pipe 21, the front member 22*a* of the front side cap member 22, the purification tube member 28, the air flow pipe 29, and the purification tube member 30 comprise an "exhaust pipe" of the invention.

In addition, an axis L1 of the purification tube member 28, an axis L2 of the air flow pipe 29, and an axis L3 of the purification tube member 30 are respectively linear. Furthermore, these three axes L1 to L3 are arranged to form a substantially straight line.

In addition, one end of a downstream side pipe 31*a* of a secondary air induction pipe 31 for introducing secondary air is connected to the small diameter section 29*b* of the air flow pipe 29 such that an axis L4 of the downstream side pipe 31*a* is substantially perpendicular to the axis L2 of the air flow pipe 29. However, in alternative arrangements, the axis of the air supply pipe, or downstream side pipe 31*a*, may be canted at an angle other than 90 degrees with respect to the axis L2 of the air flow pipe 29. Note that, the secondary air induction pipe 31 is one example of an "air supply pipe" of the preferred embodiment. Moreover, because the portion of the air flow pipe 29 to which the air supply pipe 31 is connected is at least substantially linear, a relatively smooth flow of exhaust gas past the air supply pipe 31 is provided. Thus, the flow of exhaust gas effectively draws air into the air flow pipe 29, through the air supply pipe 31, by a venturi effect. In addition, taking into consideration the fact that a reduced level of oxygen is supplied to the purification tube member 30 on the rear side as a result of oxygen being consumed in the purification tube member 28 as a result of oxidation that occurs in the purification tube member 28, the secondary air induction pipe 31 is provided to make sure that ample oxygen (air) is supplied to the purification tube member 30.

In addition, in the illustrated embodiment, the downstream side pipe 31*a* of the secondary air induction pipe 31 is formed to extend outside of the muffler 15 via the connection section of the front side cap member 22, the inner tubular member 23 and the outer tubular member 24. More specifically, in the illustrated embodiment, as shown in FIG. 4, a U-shaped notch 22*d* is formed in the rear section of the front side cap body member 22*c* of the front side cap member 22, and a semi-circular notch 24*d* is formed in a region of the front section of the outer tubular member 24 that corresponds with the notch 22*d* of the front side cap member 22. Furthermore, a semi-circular notch 23*c* is formed in a region of the inner tubular member 23 that corresponds with the notch 24*b* of the outer tubular member 24. As a result, the position of a tip section of an end section of the inner tubular member 23 on the front side cap member 22 side is located in the vicinity of the position of a tip section of an end section of the outer tubular member 24 on the front side cap member 22 side, while the notch 23*c* of the inner tubular member 23 and the notch 24*b* of the outer tubular member 24 abut with the rear side of an outer surface 31*b* of the downstream side pipe 31*a* of the secondary air induction pipe 31 (the state shown in FIG. 2). Note that, in the illustrated embodiment, a notch depth D1 in direction A of the U-shaped notch 22*d* of the front side cap member 22 is formed to be larger than a notch depth D2 in direction A of the semi-circular notch 23*c* of the inner tubular member 23, and a notch depth D3 in direction A of the semi-circular notch 24*b* of the outer tubular member 24. In addition, the notch 22*d* of the front side cap member 22, the notch 23*c* of the inner tubular member 23 and the notch 24*b* of the outer tubular member 24 form an edge (refer to FIG. 2 and FIG. 3) of a through hole 15*a*. Note that, the notch 22*d* is one example of a "second notch" of the preferred embodiment, and the notch 24*b* is one example of a "first notch" of the preferred embodiment. Furthermore, the notch 23*c* is one example of a "third notch" of the preferred embodiment.

In addition, as can be seen in FIG. 2, the front side cap member 22 is fitted to the inner surfaces (23*b* and 24*a*) of the inner tubular member 23 and the outer tubular member 24 while the notch 22*d* of the front side cap member 22, the notch 23*c* of the inner tubular member 23, and the notch 24*b* of the outer tubular member 24 abut with the outer surface 31*b* of the downstream side pipe 31*a* of the secondary air induction pipe 31. In other words, the secondary air induction pipe 31 is formed to extend outside of the muffler 15 via the through hole 15*a*.

Figure 3:
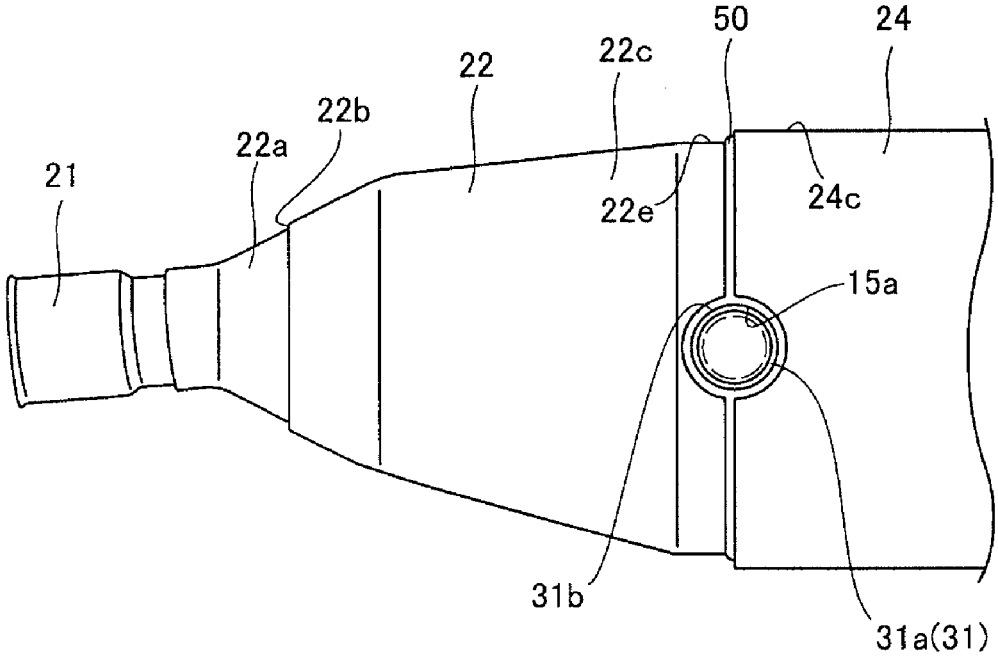
FIG. 3 is a plan view of the area surrounding a front side cap member of the muffler of the motorcycle of FIG. 1.
Figure 4:
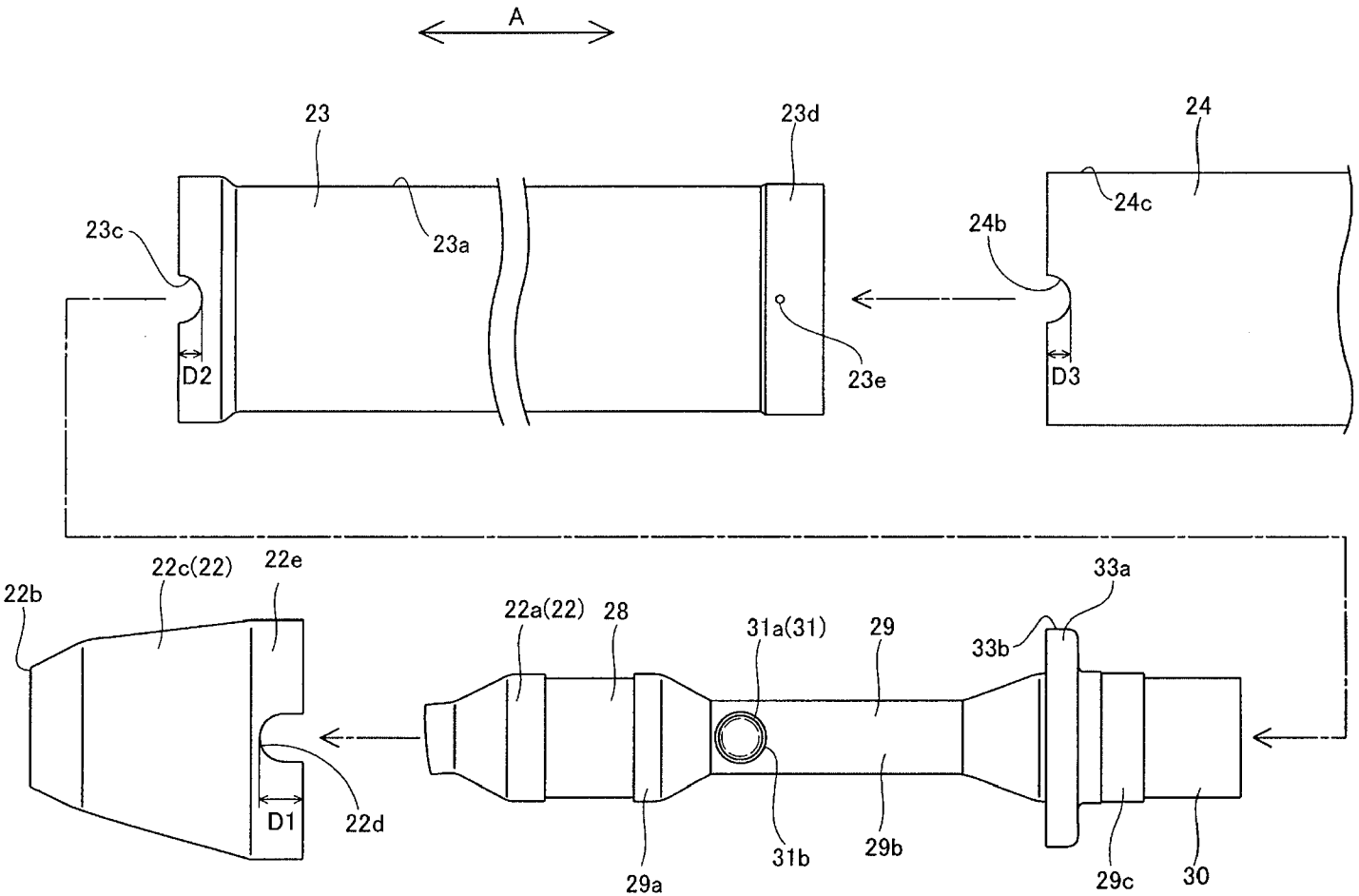
FIG. 4 is an exploded view of the muffler of the motorcycle of FIG. 1.

Moreover, the downstream side pipe 31*a* of the secondary air induction pipe 31, as shown in FIG. 2 and FIG. 3, is welded to the edge of the through hole 15*a* by weld metal or a weld bead 50 that is welded around the circumference around the outer surface 31*b* of the downstream side pipe 31*a*. Note that, welding of the rear section of the front side cap member 22, the front section of the inner tubular member 23 (refer to FIG. 2), and the front section of the outer tubular member 24 is carried out by welding the weld metal bead 50 along the outer surfaces (22*e*, 23*a* and 24*c*) of the front side cap member 22, the inner tubular member 23 and the outer tubular member 24.

In addition, in the illustrated embodiment, as shown in FIG. 3, the weld line or weld bead of the secondary air induction pipe 31 and the through hole 15*a* and the weld line or weld bead of the front side cap member 22, the inner tubular member 23 (refer to FIG. 2) and the outer tubular member 24 are continuous with each other. Furthermore, the weld line or weld bead of the secondary air induction pipe 31 and the edge of the through hole 15*a* and the weld line or weld bead of the front side cap member 22, the inner tubular member 23 and the outer tubular member 24 together form a weld line or weld bead that connects around the circumference around the outer surfaces (22*e*, 23*a*, 24*c*) of the front side cap member 22, the inner tubular member 23 and the outer tubular member 24.

In addition, as shown in FIG. 2, the other end of the downstream side pipe 31*a* of the secondary air induction pipe 31 is connected to one end of an upstream side pipe 31*c*. A reed valve housing member 32 that houses a reed valve (a check valve), not shown, is attached to the other end of the upstream side pipe 31*c*, as shown in FIG. 1. In addition, the exhaust pipe, the muffler 15, the secondary air induction pipe 31, and the reed valve housing member 32 comprise the exhaust device.

Furthermore, as shown in FIG. 2, a support member 33 that supports the air flow pipe 29 is attached to the outer surface of the large diameter section 29*c* of the air flow pipe 29. The support member 33 includes a short tubular member 33*a* that extends a short distance in the axial direction (direction A) of the inner tubular member 23. An outer surface 33*b* of this short tubular member 33*a* is moveably positioned in line with the inner surface 23*b* of the inner tubular member 23. In addition, when the purifier reaches a high temperature, a rear section (the large diameter section 29*c* of the air flow pipe 29) of the purifier moves rearward in direction A, and along with this the rear section of the inner tubular member 23 moves rearward in direction A. However, under such conditions, the outer surface 33*b* of the short tubular member 33*a* of the support member 33 moves just slightly along the inner surface 23*b* of the inner tubular member 23.

Figure 5:
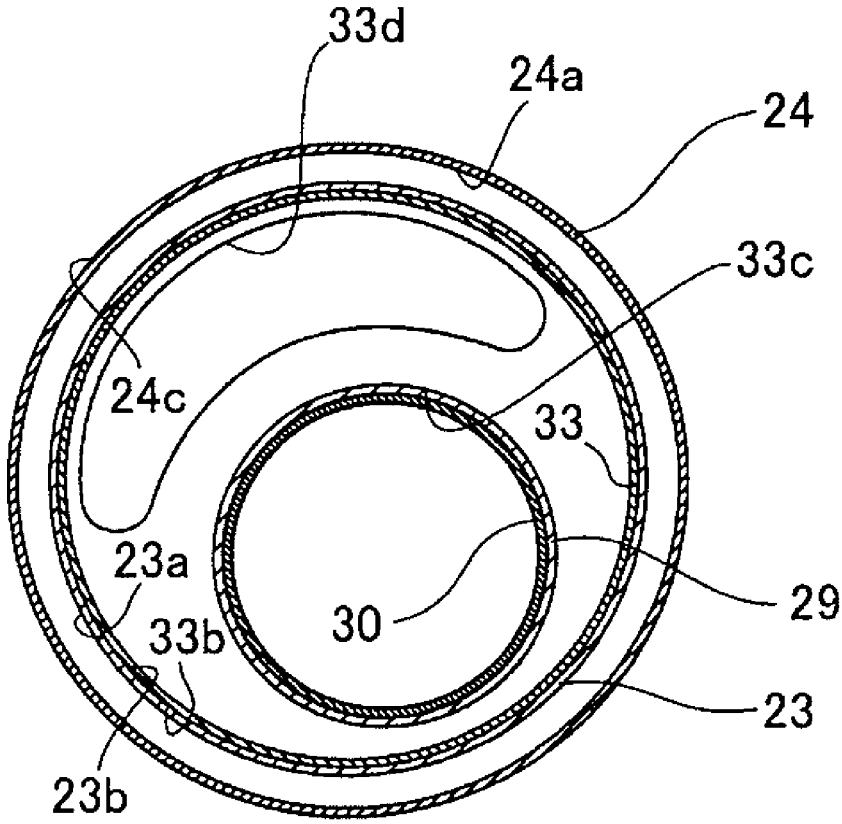
FIG. 5 is a cross sectional view of the muffler taken along line 100-100 of FIG. 2.

Furthermore, as shown in FIG. 5, an opening 33*d* and an insertion hole 33*c* in which the air flow pipe 29 is inserted are formed in the support member 33. More specifically, a space that is located to the front side of the support member 33 of the inner tubular member 23 and a space that is located to the rear side of the support member 33 are connected via the opening 33*d*.

Moreover, as shown in FIG. 2, a partition 34 that is fixed to the inner surface 23*b* of the inner tubular member 23 is disposed to the rear of the purification tube member 30. Furthermore, the front side cap member 22, the inner tubular member 23 and the partition 34 at least partially define a first expansion chamber 35. In addition, the partition 34, the inner tubular member 23 and the rear side cap member 25 at least partially define a second expansion chamber 36.

Furthermore, a wall 34*a* formed as a spherical surface is provided in the partition 34. Forming the wall 34*a* with a spherical surface shape provides the wall 34*a* with increased strength. As a result, even if high pressure exhaust gas that has passed through the purification tube member 30 (the purifier) and into the first expansion chamber 35 expands and generates a large sound, the wall 34*a* is able to inhibit vibration. As a result, the sound generated by expansion of the exhaust gas is inhibited from being fully transmitted to the second expansion chamber 36.

Figure 6:
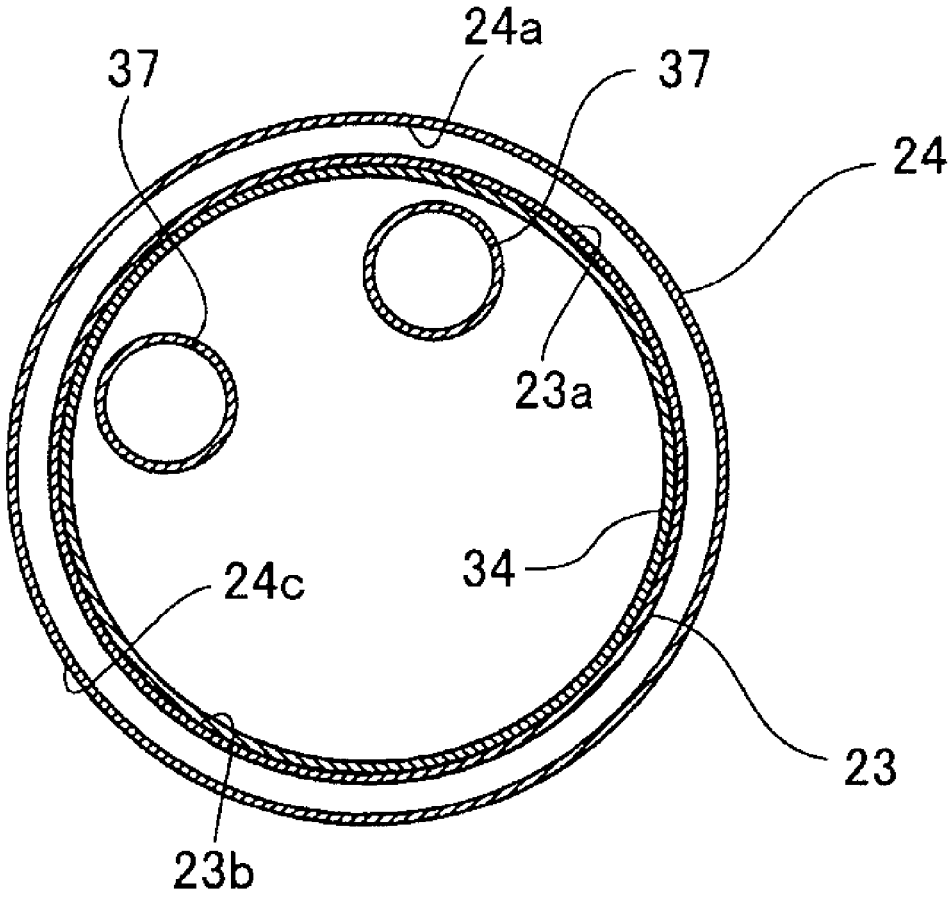
FIG. 6 is a cross sectional view of the muffler taken along line 200-200 of FIG. 2.

In addition, as shown in FIG. 2 and FIG. 6, two connection pipes 37 are attached to the partition 34. The connection pipes 37, as shown in FIG. 2, function to connect the first expansion chamber 35 and the second expansion chamber 36, and to allow exhaust gas to pass from the first expansion chamber 35 to the second expansion chamber 36. In addition, a front side opening surface 37*a* of the connection pipes 37 is disposed further to the front side in the axial direction (direction A) of the inner tubular member 23 than a rear side opening surface 30*a* of the purification tube member 30. As a result, the large noise generated when exhaust gas that has passed through the purification tube member 30 expands is inhibited from directly entering into the connection pipes 37, whereby the sounds generated by expansion of the exhaust gas is inhibited from being fully transmitted to the second expansion chamber 36.

A discharge pipe 38 for exhausting exhaust gas that passes through the connection pipes 37 to outside of the muffler 15 is provided in the rear side cap member 25. A front side opening surface 38*a* of the discharge pipe 38 is disposed further forward in the axial direction (direction A) of the inner tubular member 23 than the rear side opening surface 37*b* of the connection pipes 37. As a result, the noise generated by expansion of the exhaust gas that has passed through the connection pipes 37 is inhibited from directly entering into the discharge pipe 38.

The discharge pipe 38 is fixed to a support member 25*a* of the rear side cap member 25. Further, a rear side cap body member 25*b*, which the support member 25*a* can be attached to, is included in the rear side cap member 25. Moreover, as shown in FIG. 8, a rear end section of the outer tubular member 24 and the rear side cap body member 25*b* are welded to the support member 25*a* of the rear side cap member 25 by a weld metal bead 51.

Figure 7:
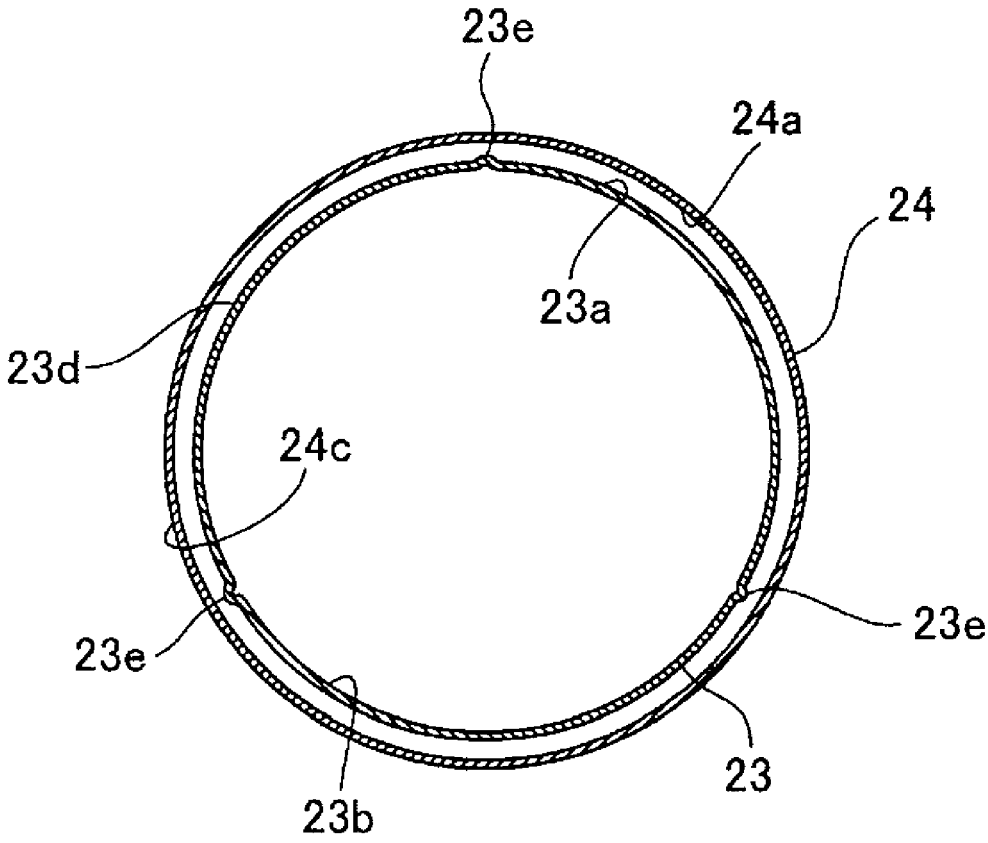
FIG. 7 is a cross sectional view of the muffler taken along line 300-300 of FIG. 2.

Moreover, a ring shaped member or annular member 39 is disposed between the outer surface 23*a* of the inner tubular member 23 and the inner surface 24*a* of the outer tubular member 24. The ring shaped member 39, as shown in FIG. 2 and FIG. 8, is disposed above the outer surface 23*a* of a rear end section 23*d* of the inner tubular member 23. Furthermore, as shown in FIG. 7 and FIG. 8, three protrusions 23*e* having a protrusion height H (FIG. 8) that is smaller than an outer diameter D4 (FIG. 8) of the ring shaped member 39 are formed in a section of the outer surface 23*a* of the rear end section 23*d* at positions that are further to the front side in the axial direction of the inner tubular member 23 and the outer tubular member 24 (direction A in FIG. 8) than the ring shaped member 39. The protrusions 23*e* are formed in an integrated manner at 120 degrees of separation from each other. However, the protrusions may be separate members as well. As a result, the ring shaped member 39 is inhibited from moving further to the front side than the protrusions 23*e* of the inner tubular member 23.

Figure 8:
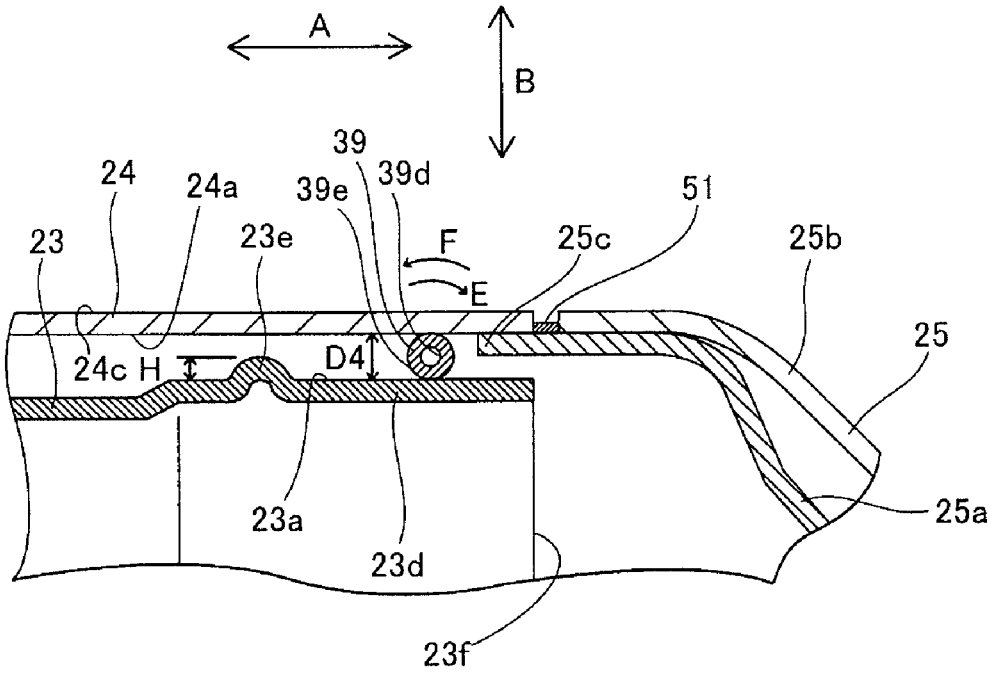
FIG. 8 is a cross sectional view of rear portion of the muffler including a ring shaped or annular member positioned between inner and outer tubular members of the muffler of the motorcycle of FIG. 1.

In addition, as shown in FIG. 8, a front end section 25*c* of the rear side cap member 25 is disposed rearward of the ring shaped member 39 in the axial direction (direction A) of the inner tubular member 23 and the outer tubular member 24, and at a section that is further to the front side than a rear side opening surface 23*f* of the inner tubular member 23.

Figure 9:
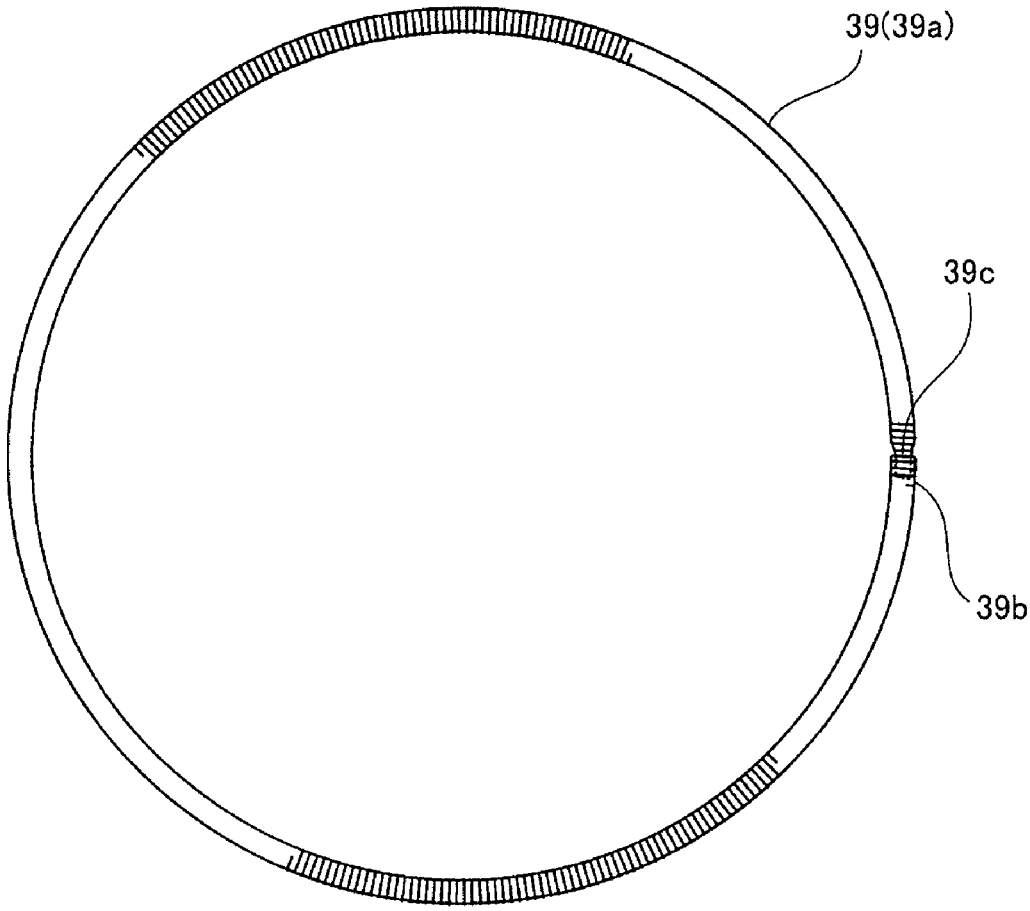
FIG. 9 is a plan view of the ring shaped member of the motorcycle of FIG. 1.

The ring shaped member 39, as shown in FIG. 9, is formed by shaping a coil member 39*a* into a ring shape or annulus. The coil member 39*a* preferably is made from an extension coil spring formed by winding a metal wire into a coil shape. More specifically, the coil member 39*a* includes one end 39*b* and another end 39*c* having a cross section that is substantially hollow. As a result of forming the ring shaped member 39 (the coil member 39*a*) to have a hollow cross section in this manner, the ring shaped member 39 can be elastically deformed in the direction that is perpendicular to the outer surface 23*a* of the inner tubular member 23 and the inner surface 24*a* of the outer tubular member 24 (direction B shown in FIG. 8) between the outer surface 23*a* of the inner tubular member 23 (refer to FIG. 8) and the inner surface 24*a* of the outer tubular member 24 (refer to FIG. 8).

The one end 39*b* of the coil member 39*a* has an external diameter that is the same as the external diameter of a section extending between the one end 39*b* and the other end 39*c* of the coil member 39*a*. The other end 39*c* of the coil member 39*a* has an external diameter that is smaller than the one end 39*b*. More specifically, the coil member 39*a* is an extension coil spring that has substantially the same external diameter in which just one end (the other end 39*c*) has been formed with a smaller external diameter. Furthermore, the other end 39*c* of the coil member 39*a* has an external diameter that is the same as, or slightly larger than, the internal diameter of the one end 39*b*.

Moreover, as shown in FIG. 8, an outer periphery section 39*e* of the ring shaped member 39, which has a substantially hollow cross section, is generally ring shaped. As a result, when the rear end section 23*d* of the inner tubular member 23 has moved to the rear side cap member 25 side (the rear side) as a result of the inner tubular member 23 expanding at high temperatures, the ring shaped member 39 can move while rotating in direction E or direction F with respect to the outer surface 23*a* of the inner tubular member 23 and the inner surface 24*a* of the outer tubular member 24.

Figure 10:
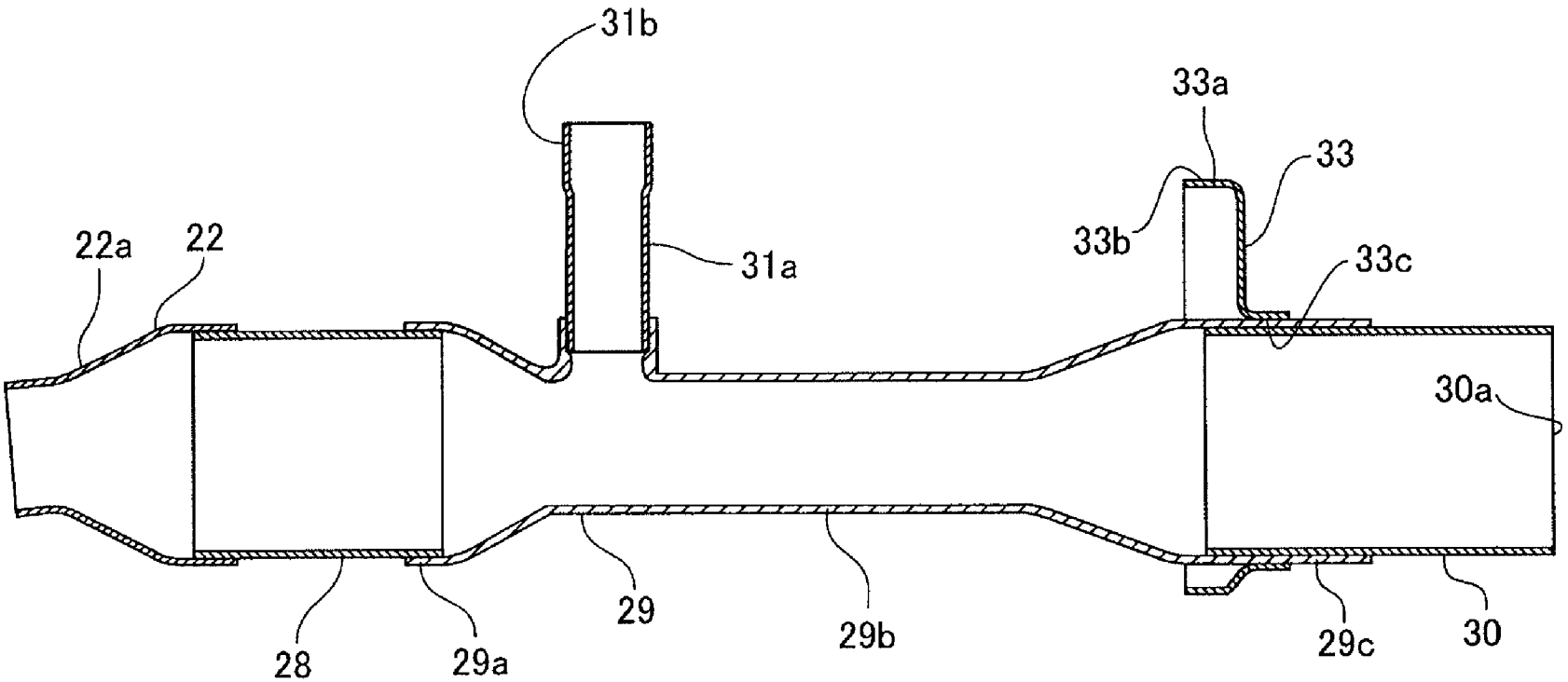
FIG. 10 is a cross sectional view of an air flow pipe of the muffler of the motorcycle of FIG. 1 removed from the muffler.

FIG. 10 is a cross sectional view showing a periphery area of the air flow pipe of the motorcycle shown in FIG. 1. An attachment (assembly) process used for attaching the front side cap member 22 to the inner tubular member 23 and the outer tubular member 24 of the motorcycle 1 according to this embodiment is explained with reference to FIG. 2 to FIG. 4, and FIG. 10.

First, as shown in FIG. 10, the purification tube member 28, to which the front member 22*a* of the front side cap member 22 is connected, is fixed to the large diameter section 29*a* of the air flow pipe 29, and the large diameter section 29*c* of the air flow pipe 29 is connected to the purification tube member 30. Then, the downstream side pipe 31*a* of the secondary air induction pipe 31 is connected to the small diameter section 29*b* of the air flow pipe 29, and the support member 33 is fixed to the outer surface of the large diameter section 29*c* of the air flow pipe 29.

Next, from the state shown in FIG. 4, the notch 22*d* of the front side cap member 22 is placed into contact with the front side of the outer surface 31*b* of the downstream side 31*a* of the secondary air induction pipe 31, and the notch 23*c* of the inner tubular member 23 and the notch 24*b* of the outer tubular member 24 are placed into contact with the rear side of the outer surface 31*b* of the downstream side 31*a* of the secondary air induction pipe 31. At this time, in the illustrated embodiment, the notch 23*c* has been formed in the region of the inner tubular member 23 that corresponds with the notch 24*b* of the outer tubular member 24. As a result, the end section of the inner tubular member 23 at the front side cap member 22 side is disposed to extend along the end section of the outer tubular member 24 on the front side cap member 22 side. In addition, the front member 22*a* of the front side cap member 22 is inserted to and connected with the insertion member 22*b* of the front side cap body member 22*c*. As a result, as shown in FIG. 2, the front side cap member 22 is fitted to the inner surfaces (23*b* and 24*a*) of the inner tubular member 23 and the outer tubular member 24.

Next, as shown in FIG. 2 to FIG. 3, the rear section of the front side cap member 22, the front section of the inner tubular member 23 (refer to FIG. 2), and the front section of the outer tubular member 24 are welded by the weld metal bead 50 around the circumference of the outer surfaces (22*e*, 23*a*, and 24*c*) of the front side cap member 22, the inner tubular member 23 and the outer tubular member 24. In addition, the downstream side pipe 31*a* of the secondary air induction pipe 31 is welded to the edge of the through hole 15*a* by passing the weld metal bead 50 around the circumference of the outer surface 31*b* of the downstream side pipe 31*a*. At this time, in this embodiment, the weld line or weld bead of the front side cap member 22, the inner tubular member 23 and the outer tubular member 24 and the weld line of the secondary air induction pipe 31 and the through hole 15*a* connect with each other. As a result, after the front side cap member 22, the inner tubular member 23 and the outer tubular member 24 have been welded, it is possible to successively and continuously weld the secondary air induction pipe 31 and the edge of the through hole 15*a*. As a result, the assembly operation is easier to carry out.

The above-described process is used to attach (assemble) the front side cap member 22 to the inner tubular member 23 and the outer tubular member 24 of the motorcycle 1 according to a preferred embodiment.

In the embodiment described above, the secondary air induction pipe 31 is formed to extend outside of the muffler 15 via the through hole 15*a* which has the edge structured by the notch 22*d* of the front side cap member 22, the notch 23*c* of the inner tubular member 23 and the notch 24*b* of the outer tubular member 24. As a result, when assembly is carried out, it is possible to connect the front side cap member 22, the inner tubular member 23 and the outer tubular member 24 such that the secondary air induction pipe 31 is interposed therebetween. Accordingly, the secondary air induction pipe 31 is positioned so as to extend to the outside of the muffler 15 without having to insert the secondary air induction pipe 31 into the through hole 15*a* of the muffler 15. As a result, the assembly operation of the exhaust device can be carried out more easily. In addition, the secondary air induction pipe 31 is formed to extend outside of the muffler 15 via the through hole 15*a* which has the edge structured by the notch 22*d* of the front side cap member 22, the notch 23*c* of the inner tubular member 23 and the notch 24*b* of the outer tubular member 24. As a result, when assembly is carried out, the secondary air induction pipe 31 can be connected to the small diameter section 29*b* of the air flow pipe 29 in advance, and following this the front side cap member 22, the inner tubular member 23 and the outer tubular member 24 can be connected such that the secondary air induction pipe 31 is interposed therebetween. Accordingly, as compared to an assembly operation in which, after the secondary air induction pipe 31 has been inserted in the through hole 15*a*, the secondary air induction pipe 31 and the air flow pipe 29 are connected by welding etc. while the secondary air induction pipe 31 is inserted in the through hole 15*a*, the assembly operation is easier to carry out.

In addition, in the embodiment described above, the purification tube member 28 is disposed between the portion of the front member 22*a* of the front side cap member 22 that is connected to the front side cap body member 22*c* and the portion of the air flow pipe 29 that is connected to the secondary air induction pipe 31. As a result, the purification tube member 28 is disposed to the engine 11 side (the upstream side) of the muffler 15, whereby the purification tube member 28 is disposed relatively near the engine 11. Accordingly, high temperature exhaust gas is able to flow into the purification tube member 28, whereby it is possible to reduce the time required to raise the temperature of the purification tube member 28 to the temperature at which the exhaust gas is effectively purified (the activation temperature). Furthermore, as a result of positioning the purification tube member 28 between the section of the front member 22*a* of the front side cap member 22 that is connected to the front side cap body member 22*c* and the section of the air flow pipe 29 that is connected to the secondary air induction pipe 31, the purification tube member 28 is disposed inside the muffler 15. As a result, it is possible to inhibit the purification tube member 28 from being cooled by the outside atmosphere. This feature also makes it possible to reduce the time required to raise the temperature of the purification tube member 28 to the temperature at which the exhaust gas is effectively purified (the activation temperature).

In addition, in the illustrated embodiment, the front side cap body member 22*c* of the front side cap member 22 is fitted to the inner surfaces (23*b* and 24*a*) of the inner tubular member 23 and the outer tubular member 24, and the U-shaped notch 22*d* of the front side cap body member 22*c* of the front side cap member 22 is formed with a notch depth that is larger than the semi-circular notch 23*c* of the inner tubular member 23 and the semi-circular notch 24*b* of the outer tubular member 24. As a result, the notch depth D2 of the notch 23*c* of the inner tubular member 23 and the notch depth D3 of the notch 24*b* of the outer tubular member 24 are not overly large. As a result, the length of the boundary line of the front side cap member 22, the inner tubular member 23, and the outer tubular member 24 is not long when viewed from the outside. As a result, when the connection section of the front side cap member 22, the inner tubular member 23 and the outer tubular member 24 is welded, the length that needs to be welded is not excessively long. As a result, the assembly operation is easier to carry out. In addition, the U-shaped notch 22*d* of the front side cap body member 22*c* of the front side cap member 22 is formed with a notch depth that is larger than the semi-circular notch 23*c* of the inner tubular member 23 and the semi-circular notch 24*b* of the outer tubular member 24. Accordingly, when the secondary air induction pipe 31 and the edge of the through hole 15*a* are fixed, even if the exhaust pipe with the connected secondary air induction pipe 31 is fixed in a displaced state with respect to the muffler 15, the secondary air induction pipe 31 is disposed such that it is displaced in the depth direction (direction A) of the U-shaped notch 22*d* of the front side cap body member 22*c* of the front side cap member 22. Accordingly, it is possible to inhibit the secondary air induction pipe 31 from being fixed in a state in which it pushes against the edge of the through hole 15*a*, whereby it is possible to inhibit excessive residual stress from being generated in the secondary air induction pipe 31. As a result, it is possible to inhibit stress of the secondary air induction pipe 31 from becoming too large, as a result of thermal stress caused by heat of the exhaust gas from the engine 11 being applied to the secondary air induction pipe 31 when residual stress is generated in the secondary air induction pipe 31.

Moreover, in the embodiment described above, the weld line of the front side cap member 22, the inner tubular member 23 and the outer tubular member 24, and the weld line of the secondary air induction pipe 31 and the edge of the through hole 15*a* form a weld line or weld bead that connects around the circumference around the outer surfaces (22*e*, 23*a* and 24*c*) of the front side cap member 22, the inner tubular member 23 and the outer tubular member 24. As a result, as compared to a structure in which the weld line that connects around the circumference around the outer surfaces (22*e*, 23*a* and 24*c*) of the front side cap member 22, the inner tubular member 23 and the outer tubular member 24 is formed by just the weld line of the front side cap member 22, the inner tubular member 23 and the outer tubular member 24, it is possible to shorten the weld line of the front side cap member 22, the inner tubular member 23 and the outer tubular member 24, whereby assembly time can be reduced.

In addition, in the illustrated embodiment, the notch 23*c* is formed in the region of the inner tubular member 23 that corresponds with the notch 24*b* of the outer tubular member 24. Accordingly, the position of the tip section of the end section of the inner tubular member 23 on the front side cap member 22 side can be located in the vicinity of the position of the tip section of the end section of the outer tubular member 24 on the front side cap member 22 side. As a result, the front side cap member 22, the inner tubular member 23 and the outer tubular member 24 can be welded at the same time, whereby the assembly operation can be carried out more easily.

Moreover, the secondary air induction pipe 31 is welded to the air flow pipe 29 such that the axis L4 of the secondary air induction pipe 31 is generally perpendicular to the axis L2 of the air flow pipe 29. As a result, as compared to a structure in which the secondary air induction pipe 31 is welded to the air flow pipe 29 with the axis L4 of the secondary air induction pipe 31 inclined with respect to the axis L2 of the air flow pipe 29, it is easier to weld the secondary air induction pipe 31 to the air flow pipe 29.

Note that, in the embodiments disclosed herein, all of the described features are exemplary in nature, and thus are not intended to limit the invention. The scope of the invention is defined by the claims and not by the description of the above-described embodiment. In addition, the invention includes structures that are equivalent to the scope of the claims and all modifications that come within the scope of the claims.

For example, in the above-described embodiment, a motorcycle is described as one example of a vehicle provided with the exhaust device. However, the invention is not limited to this, and so long as a vehicle is provided with the exhaust device, the invention may be applied to other vehicles such as an automobile, a three-wheel vehicle, an ATV (All Terrain Vehicle) or the like.

In addition, the above-described embodiment explains an example in which the exhaust device is applied to a vehicle. However, the invention is not limited to this, and the exhaust device may be applied to devices other than those used in a vehicle.

In addition, the above-described embodiment explains an example in which the secondary air induction pipe is formed to extend outside of the muffler via the through hole formed by the front side cap member, the inner tubular member and the outer tubular member. However, the invention is not limited to this structure, and the through hole may be formed by the inner tubular member, the outer tubular member, and the rear side cap member, and the secondary air induction pipe may be formed to extend to the outside of the muffler via the through hole.

Furthermore, the above-described embodiment describes an arrangement in which the through hole is formed by the front side cap member, the inner tubular member, and the outer tubular member. However, the invention is not limited to this structure, and the through hole may be formed by just the front side cap member and the outer tubular member.

In addition, the above-described embodiment explains a structure in which the purification tube member disposed further to the upstream side than the secondary air induction pipe of the exhaust pipe is positioned inside the muffler. However, the invention is not limited to this structure, and the purification tube member disposed further to the upstream side than the secondary air induction pipe of the exhaust pipe may be positioned outside the muffler. In other words, the purification tube member may be provided in the external exhaust pipe.

Furthermore, the above-described embodiment describes an example in which the through hole is formed by providing respective notches in each of the front side cap member, the inner tubular member, and the outer tubular member. However, the invention is not limited to this structure, and the through hole may be formed by providing a notch in just one of the front side cap member, the inner tubular member, and the outer tubular member, without providing notches in the other ones of the front side cap member, the inner tubular member, and the outer tubular member.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. An exhaust device for a vehicle, comprising:

an exhaust pipe including a first end portion and a second end portion, the first end portion of the exhaust pipe being connectable to an engine of the vehicle;

a muffler comprising an outer wall defining an internal space of the muffler, the outer wall of the muffler defined by at least a first member and a second member connected to a longitudinal end of the first member such that the first member and the second member extend consecutively along a length of the muffler, the muffler additionally comprising a third member arranged to extend within the first member, and wherein the second end portion of the exhaust pipe is located within said internal space;

a first purification member arranged to purify exhaust gas;

an air supply pipe arranged to supply air to the exhaust pipe, the air supply pipe comprising:

a first end of the air supply pipe supported by a portion of the exhaust pipe located within the internal space of the muffler, an opening at the first end of the air supply pipe discharging into the exhaust pipe;

a second end of the air supply pipe supported by an edge of the first member, an edge of the second member, and an edge of the third member, wherein the second end is interposed between the edges of the first and third members and the edge of the second member so that the air supply pipe extends to the outside of the muffler via a through hole in the outer wall; and a solid wall extending between the first end and the second end;

wherein the air supply pipe is arranged to supply air to the exhaust pipe at a location upstream from the first purification member relative to a flow of exhaust gas within the exhaust pipe.

2. The exhaust device of claim 1, wherein one of the first member and the second member of the muffler comprises an exhaust pipe insertion member into or onto which the exhaust pipe is inserted, the exhaust pipe being secured to the insertion member of the muffler.

3. The exhaust device of claim 1, wherein the exhaust pipe includes a second purification member for purifying exhaust gas passing through the exhaust pipe.

4. The exhaust device of claim 3, wherein the second purification member is disposed between a portion of the exhaust pipe secured to the muffler and the portion of the exhaust pipe to which the air supply pipe is connected.

5. The exhaust device of claim 3, wherein each of the first and second purification members comprises a catalyst that functions to purify exhaust gas.

6. The exhaust device of claim 1, wherein the first member comprises a tubular body member and the second member comprises a cap member connected to the tubular body member.

7. The exhaust device of claim 6, wherein the cap member is fitted within the first end portion of the tubular body member to overlap an inner surface of the first end portion and the cap member is secured to the tubular body member.

8. The exhaust device of claim 1, wherein the first member defines a first notch and the second member defines a second notch, and the first notch and the second notch cooperate to form at least a portion of the edge of the through hole.

9. The exhaust device of claim 8, wherein one of the first member and the second member is fitted to an inner surface of the other of the first member and the second member, and one of the first notch and the second notch has a depth that is larger than a depth of the other of the first notch and the second notch.

10. The exhaust device of claim 8, wherein the first member and the second member of the muffler are welded together by a first weld bead portion along an outer surface of the muffler, and the air supply pipe and the edge of the through hole of the muffler are welded together by a second weld bead portion around the outer periphery of the air supply pipe, and the first weld bead portion and the second weld bead portion are continuous with one another.

11. The exhaust device of claim 10, wherein a weld bead comprising the first weld bead portion and the second weld bead portion extends entirely around a circumference of the outer surface of the muffler.

12. The exhaust device of claim 10, wherein the third member includes a third notch that corresponds with the first notch of the first member, and wherein the first member, the second member and the third member of the muffler are secured to one another by a weld bead comprising the first weld bead portion and the second weld bead portion.

13. The exhaust device of claim 1, wherein the air supply pipe is secured to the exhaust pipe such that an axis of the air supply pipe is generally perpendicular to an axis of the exhaust pipe at the portion to which the air supply pipe is connected.

14. A vehicle, comprising:

an engine;

an exhaust pipe including a first end portion and a second end portion, the first end portion of the exhaust pipe being connectable to the engine to receive exhaust gases from the engine;

a muffler comprising an outer wall defining an internal space of the muffler, the outer wall of the muffler defined by at least a first member and a second member connected to a longitudinal end of the first member such that the first member and the second member extend consecutively along a length of the muffler, the muffler additionally comprising a third member arranged to extend within the first member, and wherein the second end portion of the exhaust pipe is located within said internal space;

a first purification member arranged to purify exhaust gas;

an air supply pipe arranged to supply air to the exhaust pipe, the air supply pipe comprising:

a first end of the air supply pipe supported by a portion of the exhaust pipe located within the internal space of the muffler, an opening at the first end of the air supply pipe discharging into the exhaust pipe;

a second end of the air supply pipe supported by an edge of the first member, an edge of the second member, and an edge of the third member, wherein the second end is interposed between the edges of the first and third members and the edge of the second member so that the air supply pipe extends to the outside of the muffler via a through hole in the outer wall; and a solid wall extending between the first end and the second end;

wherein the air supply pipe is arranged to supply air to the exhaust pipe at a location upstream from the first purification member relative to a flow of exhaust gas within the exhaust pipe.

15. The vehicle of claim 14, wherein the exhaust pipe includes a second purification member for purifying exhaust gas passing through the exhaust pipe.

16. The vehicle of claim 15, wherein the second purification member is disposed between a portion of the exhaust pipe secured to the muffler and the portion of the exhaust pipe to which the air supply pipe is connected.

17. The vehicle of claim 15, wherein each of the first and second purification members comprises a catalyst that functions to purify exhaust gas.

18. The vehicle of claim 14, wherein the first member defines a first notch and the second member defines a second notch, and the first notch and the second notch cooperate to form at least a portion of the edge of the through hole.

19. The vehicle of claim 18, wherein one of the first member and the second member is fitted to an inner surface of the other of the first member and the second member, and one of the first notch and the second notch has a depth that is larger than a depth of the other of the first notch and the second notch.

20. The vehicle of claim 18, wherein the first member and the second member of the muffler are welded together by a first weld bead portion along an outer surface of the muffler, and the air supply pipe and the edge of the through hole of the muffler are welded together by a second weld bead portion around the outer periphery of the air supply pipe, and the first weld bead portion and the second weld bead portion are continuous with one another.

21. The vehicle of claim 20, wherein the third member includes a third notch that corresponds with the first notch of the first member, and wherein the first member, the second member and the third member of the muffler are secured to one another by a weld bead comprising the first weld bead portion and the second weld bead portion.

22. The vehicle of claim 14, wherein the air supply pipe is secured to the exhaust pipe such that an axis of the air supply pipe is generally perpendicular to an axis of the exhaust pipe at the portion to which the air supply pipe is connected.

* * * * *